United States Patent [19]

Contractor et al.

[11] 4,064,597

[45] Dec. 27, 1977

[54] PREVENTION OF FIBERS FROM ENTERING THE PINCH POINT BETWEEN A ROTATING FEED ROLL AND A STATIONARY SHOE

[75] Inventors: Rashmikant Maganlal Contractor; William Carter Dodson, Jr., both of Wilmington, Del.; James John Hentges, Hendersonville, Tenn.; Earl Edwin Seppala, New Castle, Del.

[73] Assignee: E. I. Du Pont de Nemours and Company, Wilmington, Del.

[21] Appl. No.: 732,484

[22] Filed: Oct. 14, 1976

[51] Int. Cl.[2] ..... D04H 1/00

[52] U.S. Cl. ..... 19/156.3; 19/96; 19/105

[58] Field of Search ..... 19/105, 155, 156–156.4, 19/88, 89, 86, 96; 57/58.95, 58.89

[56] References Cited

U.S. PATENT DOCUMENTS

| | | | |
|---|---|---|---|
| 3,797,074 | 3/1974 | Zafiroglu | 19/156.3 |
| 3,844,097 | 10/1974 | Bobkowicz et al. | 57/58.95 X |
| 3,863,296 | 2/1975 | Buell | 19/156.3 |

FOREIGN PATENT DOCUMENTS

| | | | |
|---|---|---|---|
| 1,477,755 | 3/1967 | France | 19/105 |

*Primary Examiner*—Dorsey Newton

[57] ABSTRACT

A compressed batt of fibers is fed against a rotating toothed roll for dispersion of the fibers from the batt and this dispersion of fibers is fed through the point of closest clearance between the toothed roll and a feed roll rotating in the opposite direction. Downstream of this point of closest clearance, a stationary shoe is provided spaced from the surface of the toothed roll to permit the dispersion of fibers to follow the surface of the toothed roll. The shoe is closely fitted to the surface of the feed roll which has the effect of forming a pinch point where the feed roll enters beneath the shoe. In accordance with the invention, the shoe is equipped with passages for the flow of air to exit at the pinch point to prevent fibers from entering the pinch point, i.e., between the feed roll and shoe.

8 Claims, 3 Drawing Figures

PREVENTION OF FIBERS FROM ENTERING THE PINCH POINT BETWEEN A ROTATING FEED ROLL AND A STATIONARY SHOE

BACKGROUND OF THE INVENTION

This invention is concerned with a system for feeding a batt of staple fibers to a rotating toothed roll.

U.S. Pat. No. 3,797,074 discloses a high speed system for converting a batt of staple fibers to a uniform light weight random web, wherein a batt of staple fibers is fed to a rotating toothed roll that disperses (strips) fibers from the batt and projects these dispersed fibers at high velocity and low angle into a stable air stream of uniform velocity and low turbulence to form a thin fiber stream which is condensed against a moving screen to form the aforesaid web. The step of feeding the batt to the toothed roll involves the use of a feed roll rotating in the opposite direction to but at a lower surface speed than the toothed roll and converging the fibers against the toothed roll. A stationary shoe is provided downstream of the point of closest clearance between the feed roll and toothed roll, the shoe forming a narrow space between the shoe and toothed roll to permit the dispersion of fibers to follow the surface of the toothed roll but being closely fitted against the feed roll to support it during its rotation. Unfortunately, despite the close fitting of the shoe with the surface of the feed roll, which forms a pinch point where the feed roll enters beneath the shoe, stray fibers tend to follow the feed roll into the pinch point and form fiber wraps on the feed roll. These fibers wraps, if minor, translate into nonuniformities in the air-laid condensed web; if major, they clog the space between the feed roll and its shoe, causing the entire process to shut down.

SUMMARY OF THE INVENTION

The present invention solves this problem by an improvement which prevents fibers from entering the pinch point between the shoe and feed roll. More specifically in the process of feeding a batt of staple fibers against the surface of a rotating toothed roll for dispersion of said fibers from said batt, said feeding including passing said dispersion of fibers through the point of closest clearance between said rotating toothed roll and a feed roll rotating in the opposite direction to the toothed roll, said feed roll riding in a stationary shoe spaced from the surface of said rotating toothed roll to permit the dispersion of fibers to follow the surface of said rotating toothed roll to be formed into a web of lesser area weight than that of said batt, said feed roll forming a pinch point with said shoe downstream of said point of closest clearance, the improvement comprising preventing said dispersion of fibers from following the surface of said feed roll to enter said pinch point, by contacting the surface of said feed roll with a gaseous fluid flowing out of said pinch point.

Flow of the gaseous fluid is adjusted to blow fibers away from where the feed roll enters beneath the shoe, without disturbing the flow of fibers into the narrow space between the toothed roll and shoe. Disturbance of the flow of fibers into the narrow space would cause nonuniformities to appear in the distribution of fibers on the surface of the toothed roll and ultimately in the web formed from these fibers.

DETAILED DESCRIPTION OF THE INVENTION

Figure 1:
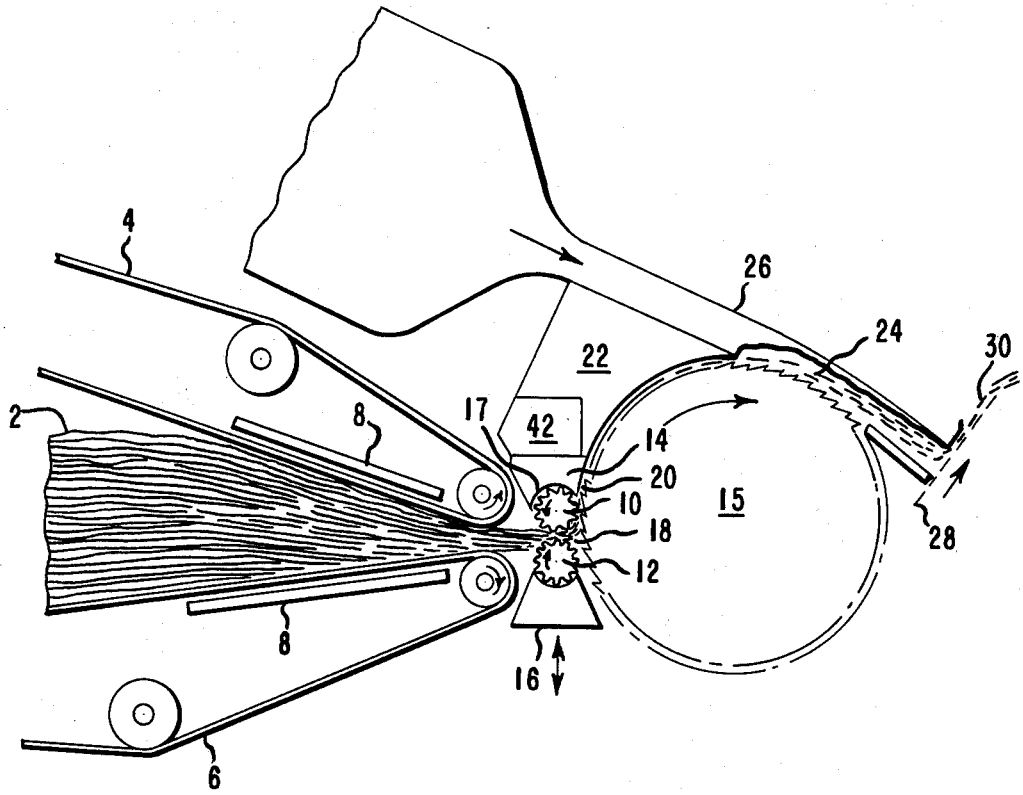
FIG. 1 is a schematic side elevation of apparatus for converting a batt of staple fibers to a uniform light weight random web.

FIG. 1 shows a batt 2 of staple fibers conveyed and compressed by the belts 4 and 6 between converging restraining means 8 and fed through the nip between positively-driven feed rolls 10 and 12 against the surface of a toothed roll 15 rotating in the direction indicated. Feed roll 10 is mounted to rotate in stationary shoe 14 and feed roll 12 is mounted to rotate in a spring-loaded shoe 16, the curvatures of the surfaces of these shoes facing rolls 10 and 12 being substantially the same as the curvatures of the surfaces of their respective rolls. The initial loose staple fiber batt, having a bulk density of no more than about 16 kg/m$^3$ and preferably weighing from 700 to 5100 g/m$^2$ (or more), is first partially compressed between the belts, is further compressed to a maximum density of at least about 64 kg/m$^3$ in the nip of the feed rolls 10 and 12, and then expands to a density of about 32 to 80 kg/m$^3$ in the transfer zone 18 between the feed rolls and toothed roll. The toothed roll 15 rotates at a greater surface speed than that of the feed rolls to disperse fibers from the batt, i.e., to strip away fibers from the fiber batt, for eventual formation of a web of lesser area weight, generally less than 150 g/m$^2$. The movement of the toothed roll 15 against the face of the batt 2 of fibers attenuates the batt in the direction of rotation of the roll. In the apparatus shown in FIG. 1, the toothed roll 15 conveys the resultant dispersion of fibers through a norrow space 20 between the toothed roll and shoe 14 and through a continuation of this narrow space between the toothed roll and a disperser plate 22. This dispersion of fibers consists of fibers caught on the teeth of the toothed roll 15 plus fibers entrained in the thin layer of high velocity air (windage air) created by and flowing (pumped) in the direction of rotation of the toothed roll. From the narrow space 20, the fibers are projected as a thin stream 24 into a duct 26 in which a stable stream of air is flowing in the direction indicated in FIG. 1 to convey the thin stream of fibers to a moving screen 28 which condenses the fibers as a lightweight uniform random web 30 of fibers. Typically, feed rolls 10 and 12 operate at a surface speed of about 1 to 5 m/min and the toothed roll at a surface speed of at least 500 times the feed roll surface speed. Further details on the operation of this apparatus to produce this result are disclosed in U.S. Pat. No. 3,797,074.

The problem arises in the operation of such apparatus that some fibers tend to follow the surface of the feed roll 10 beneath the shoe 14 instead of entering space 20, to form the fiber wraps hereinbefore described.

Figure 2:
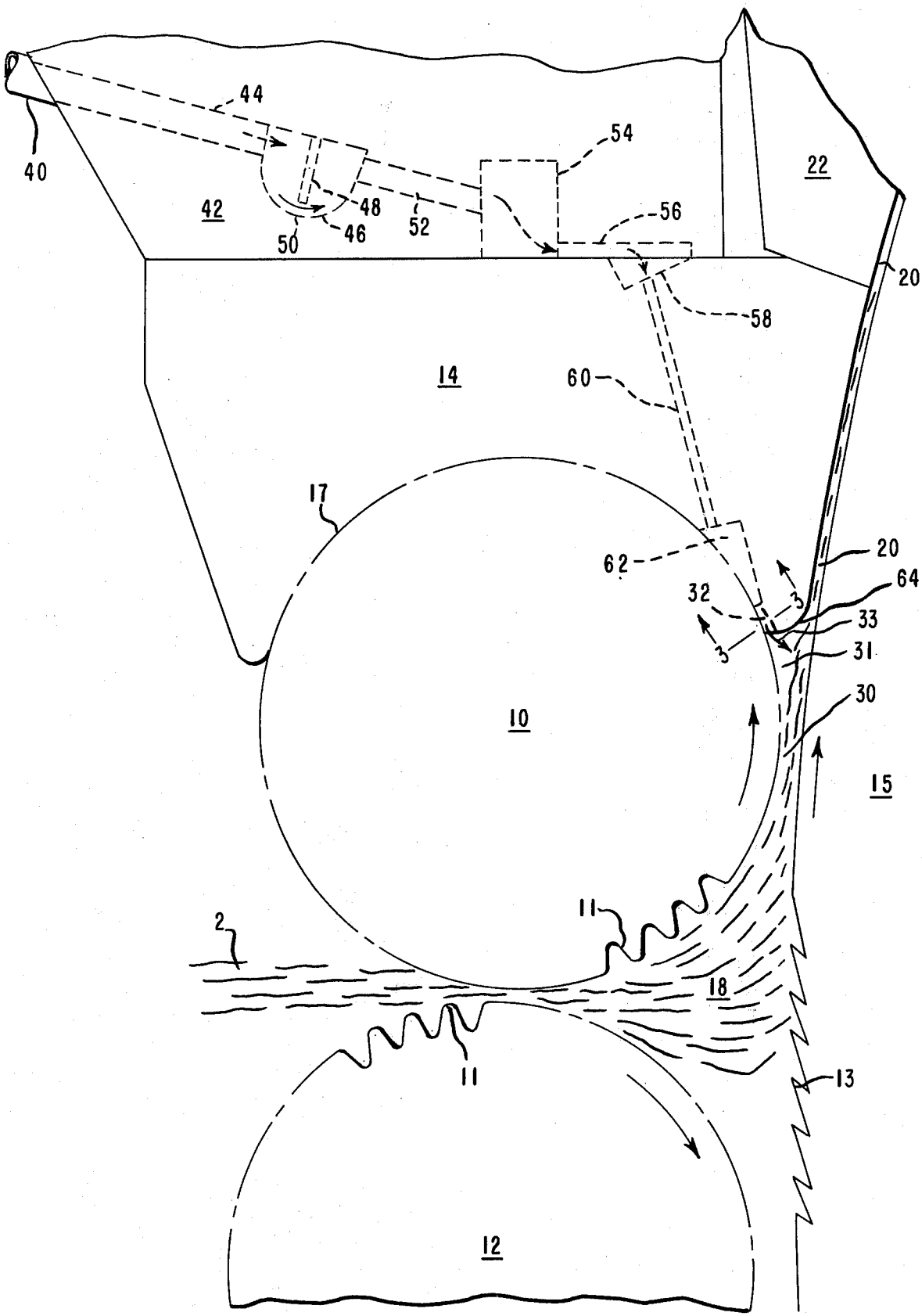
FIG. 2 is an enlargement of a portion of the apparatus of FIG. 1 in which one embodiment of the present invention is illustrated.

FIG. 2 shows this portion of the apparatus in greater detail. The shoe 14 is made of a wearable material, such as phenolic resin-impregnated fabric laminate, so that the roll 10 can ride in the shoe 14, i.e., close to or against the curved surface 17 of the shoe, which minimizes any clearance between the feed roll and shoe. The use of a smooth-surfaced feed roll also minimizes this clearance, as does bowing out of the roll 10 against surface 17 by virtue of the compression of the batt 2 of fibers at the nip between the feed rolls, in which case the shoe 14 serves as a support for the feed roll 10. Nevertheless, the fibers still have opportunity to enter beneath the shoe 14 by virtue of the practical limit in tolerances in interfitting the roll with the shoe and subsequent wear. Generally a clearance of up to 0.075 to 0.1 mm between roll 10 and surface 17 is allowed.

The preferred feed rolls are those that have an uneven surface such as the flutes 11 best shown in FIG. 2 because the uneven surface is more effective in gripping the batt 2 and pulling it through the nip between the rolls. The flutes can be straight or helical, and other forms of uneven surface can be used such as grained, pebbled, grooved, etc. Unfortunately, the uneven surface aggravates the fiber wrap problem because it is not possible to closely fit the curved surface 17 to the low points on the uneven surface. While close fitting can be achieved between high points and curved surface 17, there is a greater clearance between low points and the curved surface 17 providing easy entry for fibers beneath the shoe 14. This is especially true for flutes 11 which can have a depth into the roll of 1.5 mm and larger.

The fibers first enter beneath the shoe 14 at the tip 64 of the shoe. The stationary nature of the tip 64 relative to the rotation of feed roll 10 forms a pinch point at the tip 64, i.e., between the tip 64 of the shoe and the feed roll. This pinch point can be a continuous line across the effective width of the feed roll 10 when the flute of a straight-fluted feed roll just enters beneath the shoe 14 or is a discontinuous line when a helically-fluted roll 10 is used.

To describe the relationship between the feed rolls and toothed roll in greater detail, fluted feed roll 10 is the downstream feed roll of the pair of feed rolls because this roll is in contact with the fibers of the batt for a longer time than roll 12. The surface of feed roll 10 converges toward the surface of toothed roll 15 to form a point 30 of closest clearance with the toothed roll 15 downstream of the nip between the pair of feed rolls to bring the fibers being stripped away from the batt by the teeth 13 of the toothed roll as close as possible to the toothed roll, without the feed roll 10 and toothed roll touching one another, so that the fibers will either be caught on the teeth of the toothed roll of entrained in the thin layer of air being pumped thereby so as to enter into the narrow space 20. The tip 64 of the shoe 10 is spaced downstream of the point 30 of closest clearance and is rounded to avoid tip breakage. This location of the tip 64, however, increases the tendency of fibers in the region 31 between the toothed roll 15 and feed roll 10 to enter the pinch point at tip 64.

In accordance with the present invention, the surface of feed roll 10 is contacted with a gaseous fluid, preferably air, flowing countercurrent to the direction of rotation of the feed roll to exit at the pinch point at tip 64. This gaseous fluid exits at any clearance between the surface 17 of shoe 14 and the surface of the feed roll 10 in the region of the tip 64 of the shoe. If the feed roll has an uneven, such as fluted, surface, the gaseous fluid sweeps fibers out of the spaces between the flutes just prior to entry beneath tip 64.

One embodiment for supplying this flow of gaseous fluid is shown in FIG. 2. In greater detail, shoe 14 is provided with a series of grooves 32 (best shown in FIG. 3) in surface 17 which extend along and open against the feed roll 10. These grooves are spaced close together across the effective width of the feed roll, i.e., the width exposed to fibers, and gaseous fluid is supplied to these grooves to flow countercurrent, in the direction indicated by arrow 33, to the direction of rotation of feed roll 10 to exit at the pinch point (at tip 64) between the feed roll 10 and shoe 14. The flow of gaseous fluid from the grooves 32 at the tip 64 of shoe 14 is sufficient to prevent fibers from entering the grooves and the grooves are spaced close enough together so that the fluid flow is sufficiently uniform to sweep the entire effective width of the feed roll at the pinch point, including repelling any fibers from between flutes before entering beneath the shoe 14. Thus, fluid flow exiting at the pinch point includes fluid flow exiting by any clearance between the shoe 14 at tip 64 and roll 10, including fluid flow exiting within the grooves 32 and through the low points, such as between flutes, of the roll 10. The flow of gaseous fluid exiting at the pinch point is not so high, however, as to disturb the movement of fibers into space 20.

The flow of gaseous fluid from the grooves is preferably at least 5.5 liters/min//cm of feed roll width and more typically from 8 to 18 l/min//cm of feed roll width, determined by measurement of the air supply to all the grooves divided by the span (effective width) of the feed roll within which the grooves lie. By way of example, if the gaseous fluid pressure is substantially uniform in the fluid supplied to the grooves 32 across the effective width of the feed roll 10, then the flow of this fluid exiting at the pinch point will be sufficiently uniform when the grooves are 0.8 mm in width and are spaced on centers less than 6.35 mm apart such as on 3.18 mm centers.

Figure 3:
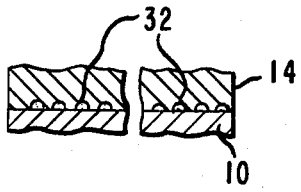
FIG. 3 shows in indeterminate length a cross section of the apparatus of FIG. 2 taken along line 3—3 thereof.

Instead of semi-circular grooves 32 as shown in FIG. 3, the uniform flow of gaseous fluid can be supplied by grooves of other cross-sectional shape or by drilled holes completely enclosed by the shoe 14 or by a continuous slot between the shoe and feed roll at the pinch point. The approach of contacting the feed roll 10 with gaseous fluid at the tip 64 of the shoe from separate channels such as grooves 32 is preferred over a continuous slot between roll 10 and shoe 14 because a continuous opening would increase the opportunity for fibers to enter the pinch point and for nonuniform gaseous fluid flow to develop and would decrease the support of the shoe for the roll 10. The cross section of the grooves in the width direction will be chosen to supply the fluid flow desired consistent with using a practical pressure supply and maintaining the support desired of the shoe for the feed roll.

Substantially uniform gaseous fluid flow from the grooves 32 across the effective width of the feed roll is provided by the design of the distribution system supplying the fluid to the grooves 32. Suitably, a single input pipe 40 for gaseous fluid in a shoe support block 42 can be subdivided into a manner of smaller passages across the width of the block 42 and shoe 14; subdividing can be done via plenums and in several stages to maintain uniform distribution of low pressure gaseous fluid across the shoe at its tip 64.

In one satisfactory arrangement, the single input line 40 feeds the gaseous fluid to a single passage 44 extending part way through the shoe support block 42 to a first plenum 46 extending along the width of the shoe support block. The plenum 46 contains a "splash" plate 48, which is mounted within the plenum substantially perpendicular to the flow of gaseous fluid into the plenum to block such flow except for a small clearance from the floor 50 of the plenum. This plate distributes the gaseous fluid flow along the length of the plenum. Extending from plenum 46 are three passages 52 extending a further distance through the shoe support block, each passage 52 (only one shown) terminating in a second plenum 54 (only one shown). The second plenums are spaced end-to-end from each other and are interconnected at their ends. Extending from each second plenum 54 are four grooves 56 (only one shown) along the interface of the block with the shoe 14 and communicating with a V-shaped trough 58 formed in the top surface of the shoe 14. From this V-shaped trough, extend 98 small passages 60 (only one shown) spaced close together to terminate in yet another V-shaped plenum 62 motched across the bottom of the shoe 14 in communication with the grooves 32.

In the foregoing described arrangement of passages and plenums, each passage 44 in the shoe support block 42 feed gaseous fluid to approximately 196 grooves 32 and the plenum 46 spans substantially over this entire distance, with the subsequent passages and plenums being substantially equally spaced within this span.

Depending on the width of the feed roll 10 and shoe 14, additional of these arrangements may be provided side-by-side in the block 42 and shoe 14 to provide the closely spaced grooves 32 extending across the entire effective width of the shoe 14 with a uniform flow of gaseous fluid. In such side-by-side arrangement, the plenums 54 of one arrangement will generally be interconnected with the plenums 54 of the adjacent arrangement and the plenums 46 will also be interconnected, but the trough 58 and plenum 62 will be continuous across the effective width of the shoe 14. Examples of dimensions for these passages and plenums are as follows: passage 44 can be 1.27 cm in diameter; plenum 46 can have a cross-sectional area of 4.7 $cm^2$ and clearance between floor 50 and splash plate 48 of 0.16 cm; passage 52 can be 0.66 cm in diameter; plenum 54 can be 1.61 $cm^2$ in cross section; grooves 56 can have a cross-sectional area of 0.081 $cm^2$; V-shaped trough 58 can be 0.28 $\times$ 0.50 cm (0.07 $cm^2$ cross-sectional area) measured on the sides of the V-shape, passages 60 can be 1 mm in diameter and spaced on 6.35 mm centers; and plenum 62 can be 0.5 $\times$ 0.2 cm (0.05 $cm^2$ cross-sectional area) measured on the sides of V-shape. Preferably, the distance between the tip 64 and the nearest side of the V-shaped plenum 62 is less than the distance between flutes when the feed roll 10 is fluted. This prevents fibers present in a valley between a pair of flutes from being trapped there by entry beneath the shoe 14. For example, the distance between flutes (center-to-center) can be 4.7 mm while the distance along the grooves 32 can be 3.8 mm. The cross-section dimensions of the plenums are in the plane of FIG. 2 and of the passages and grooves are perpendicular to the direction of gaseous fluid flow.

In operation, gaseous fluid is introduced into each pipe 40 at a pressure of about 1.05 $kg/cm^2$ which provides a gaseous fluid flow of about 8.9 l/min//cm of feed roll width emerging from grooves 32 and exiting at the pinch point between the tip 64 of shoe 14 and the feed roll 10. The operation of feeding batt 2 to the nip between feed rolls 10 and 12 is then begun. The toothed roll 15 strips away fibers from the batt being fed against it and carries these fibers into the narrow space 20 between shoe 14 and roll 15, and the flow of gaseous fluid emerging from grooves 32 prevents the fibers from entering the space between the feed roll 10 and shoe 14 and repels any fibers present between flutes in the feed roll.

As many apparently widely different embodiments of this invention may be made without departing from the spirit and scope thereof, it is to be understood that this invention is not limited to the specific embodiments thereof except as defined in the appended claims.

What is claimed is:

1. In the process of feeding a batt of staple fibers against the surface of a rotating toothed roll for dispersion of said fibers from said batt, said feeding including passing said dispersion of fibers through the point of closest clearance between said rotating toothed ball and a feed roll rotating in the opposite direction to the toothed roll, said feed roll riding in a stationary shoe spaced from the surface of said rotating toothed roll to permit the dispersion of fibers to follow the surface of said rotating toothed roll to be formed into a web of lesser area weight than that of said batt, said feed roll forming a pinch point with said shoe downstream of said point of closest clearance, the improvement comprising preventing said dispersion of fibers from following the surface of said feed roll to enter said pinch point, by contacting the surface of said feed roll with a gaseous fluid flowing out of said pinch point, the flow of gaseous fluid being of low volume so as not to disturb the uniformity of said dispersion of fibers on the surface of said rotating toothed roll.

2. The process of claim 1 wherein said gaseous fluid is air.

3. Apparatus for converting a batt of staple fibers into a web of lesser area weight comprising means for compressing a batt of fibers, a rotating toothed roll, a pair of rotating feed rolls feeding the compressed batt of fibers against the surface of said rotating toothed roll, the rotation of said toothed roll being at a greater surface speed than that of said feed rolls for dispersing fibers from said batt and projecting said fibers from said toothed roll as a thin fiber stream, and a screen for condensing the fibers of said stream into said web of lesser area weight, the surface of the downstream roll of said pair of feed rolls converging toward the surface of said toothed roll and rotating in the opposite direction thereas, a stationary shoe downsteam of the point of closest clearance between the converging surfaces of said feed roll and said toothed roll, said downstream feed roll riding in said stationary shoe to form a pinch point where said downstream feed roll enters beneath said stationary shoe, and means for supplying a flow of gaseous fluid exiting out of said pinch point to prevent fibers from entering said pinch point.

4. In the process of claim 1 wherein there is a clearance of up to 0.1 mm between said feed roll and said stationary shoe.

5. The apparatus of claim 4 wherein grooves are present in the surface of said stationary shoe, said grooves being open against said surface of said downstream feed roll, and being open at said pinch point, and said flow of gaseous fluid exiting out of said pinch point including flow along said grooves.

6. The apparatus of claim 5 wherein said grooves are spaced on centers less than 6.35 mm apart.

7. The apparatus of claim 6 wherein said surface of said stationary shoe has a plenum from which said grooves extend and from which said gaseous fluid is supplied to said grooves.

8. The apparatus of claim 7 wherein said surface of said downstream feed roll has flutes and the distance along said grooves is less than the distance between said flutes.

* * * * *